US006089387A

United States Patent [19]

Varfolomeeva

[11] Patent Number: 6,089,387

[45] Date of Patent: Jul. 18, 2000

[54] DISPLAY EQUIPMENT

[76] Inventor: Elena P. Varfolomeeva, U.T.M. Co. Svs 1028, 208 E. 51st St., Suite 295, New York, N.Y. 10022

[21] Appl. No.: 08/933,095

[22] Filed: Sep. 18, 1997

[51] Int. Cl.[7] ..... A47F 5/00

[52] U.S. Cl. ..... 211/181.1; 211/106; 211/90.03; 211/187; 211/133.5; 211/193

[58] Field of Search ..... 211/103, 90.01, 211/106, 90.02, 90.03, 90.04, 133.2, 133.5, 186, 187, 126.9, 88.01, 193; 411/366, 399, 427, 400

[56] References Cited

U.S. PATENT DOCUMENTS

| | | | |
|---|---|---|---|
| D. 259,315 | 5/1981 | Ford et al. . | |
| 1,577,210 | 3/1926 | Emerson . | |
| 2,743,020 | 4/1956 | Rubenstein | 211/181.1 X |
| 3,680,712 | 8/1972 | Jurasek . | |
| 3,704,507 | 12/1972 | Grube . | |
| 4,109,797 | 8/1978 | Brunette | 211/133.5 |
| 4,248,352 | 2/1981 | White | 211/88.01 |
| 4,416,380 | 11/1983 | Flum . | |
| 4,511,047 | 4/1985 | Elinsky | 211/90.03 |
| 4,884,702 | 12/1989 | Rekow . | |
| 4,960,214 | 10/1990 | Sayers . | |
| 5,059,077 | 10/1991 | Schmid | 411/400 |
| 5,072,839 | 12/1991 | Arnone . | |
| 5,240,124 | 8/1993 | Buday . | |
| 5,272,991 | 12/1993 | Carrigan | 211/193 X |
| 5,449,076 | 9/1995 | Van Noord . | |
| 5,477,970 | 12/1995 | Watt et al. . | |
| 5,503,279 | 4/1996 | Wentworth . | |
| 5,505,318 | 4/1996 | Goff | 211/90.04 X |
| 5,513,908 | 5/1996 | Williams . | |
| 5,622,415 | 4/1997 | Felsenthal et al. . | |
| 5,641,083 | 6/1997 | Metcalf | 211/187 |
| 5,788,093 | 8/1998 | Krut | 211/90.03 X |

FOREIGN PATENT DOCUMENTS

| | | |
|---|---|---|
| 411278 | 11/1966 | Germany . |
| 87/00015 | 1/1987 | WIPO . |

*Primary Examiner*—Robert W. Gibson, Jr.
*Attorney, Agent, or Firm*—Richard C. Litman

[57] ABSTRACT

A display equipment system for use in stores for displaying merchandise such as non-perishable foods on standing or hanging racks with lightweight open wire baskets or containers. The racks are assembled from interfitting parts and disassembled readily for placement in different areas of the store at different heights for display of the goods. The number of containers on each rack can be varied in height as well as in length. Unique two-part fasteners with or without hooks are employed to hang the baskets on the racks and hold the rack frame parts together.

20 Claims, 8 Drawing Sheets

DISPLAY EQUIPMENT

BACKGROUND OF THE INVENTION

1. Field of the Invention

The present invention relates to a display equipment system for use in stores or the like for displaying merchandise such as non-perishable foods on free standing or hanging racks with lightweight open wire baskets or containers. The racks can be assembled from a package of disassembled interfitting parts readily assembled in different configurations for placement in various areas of the store at different heights for display of the goods. The number of baskets or containers on each rack can be varied in height as well as in length of the baskets commensurate with the width of the rack. A unique assortment of fasteners for quickly assembling and disassembling the display rack units and segments is an essential part of the present invention.

2. Description of the Related Art

The related art describes various display equipment for holding goods and the like. The display equipment art is a crowded art in which the present invention establishes a niche. The art of interest will be discussed in the order of perceived relevance to the present invention.

PCT Patent Application No. WO 87/00015 published on Jan. 15, 1987, for Nils Tallving describes a goods display stand on wheels having foldable wire trays or solid wood or metal shelves. The wire trays have an inwardly folding front wall which permits the topmost tray to be folded up first against the open rear wall of the stand, with the adjacent tray being folded next. The trays or shelves are all positioned horizontally. The frame can be designed to stand on a flat surface, fitted with wheels, hung from a wall or mounted on a wall, but with no further description how these options are implemented. The reference is distinguished by the lack of a readily dismantleable frame which is the crux of the present invention.

U.S. Pat. No. 3,680,712 issued on Aug. 1, 1972, to Stanley J. Jurasek describes a modular display rack made only from bare wires spot welded at various joints. The rack can consist of one or two sections with inclined and horizontal shelves. The inclined wire shelves have a shoulder portion only on the front. There are no separate regions on each shelf for different packages. A removable auxiliary shelf is provided for the upper section on one side. The ends of the shelves are designed to hook over and under two wires of the side frame wires. There are no suggestions for forming hollow support structures, clamps and shelf hangers for the modular display.

U.S. Pat. No. 4,960,214 issued on Oct. 2, 1990, to Richard C. Sayers describes a cassette storage basket for mounting on a rack mounted mobile storage system. The rack structure consists of a vertical rectangular frame on two horizontal support rails with caster wheels. Storage racks are mounted on two sides of the main frame with vertical and horizontal wire subframes which support the hanging removable wire baskets on which video tape cassettes are arranged. The baskets have no front rail and are designed for tilting upwards. There are no suggestions for forming hollow support structures, clamps and shelf hangers for the mobile storage system.

U.S. Pat. No. 4,884,702 issued on Dec. 5, 1989, to John A. Rekow describes a rectangular freestanding or wall installation store display rack having a plurality of pairs of horizontal rods which receive inserted brackets of various types of supports for merchandise. Vertical stiffeners spaced apart support the horizontal rods. A shelf assembly includes a wire bracket and a shelf having an offset rear edge for locking engagement with a pair of horizontal rods. A waterfall arm with notches for hanging articles is attached between two pairs of the horizontal rods. Single arm display hooks are also attached in the same manner. An inverted T stand with footings at each end supports each side of the rack. A modified form of the rack is mountable directly by fasteners and a grooved bracket to a wall. There are no suggestions for utilizing baskets and jointed parts for the display rack.

U.S. Pat. No. 5,513,908 issued on May 7, 1996, to Ralph E. Williams describes a wall mounted and floor supported modular system for assembling food service fixtures consisting of a plurality of leg assemblies having a front leg, a rear member that can be selectively suspended at desired locations from a horizontal rail, and a substantially horizontal member extending between the rear member and the front leg. Each front leg includes fastening means for supporting doors, aprons, plate shelves, panels, etc. Clips are used to removably secure shelves between the horizontal members of adjacent leg assemblies. The modular system is based on a leg assembly which is integral and not separable into parts.

U.S. Pat. No. 5,622,415 issued on Apr. 22, 1997, to Donald H. Felsenthal et al. describes a portable wardrobe frame having a rectangular shape with a clothes hanging section without shelves and a shelf section with wire shelves supporting hardboard panels. Horizontal connection pieces connect six vertical poles. The wire shelves have end projections directed in various directions to interlock with apertures oriented similarly in the vertical posts. A cloth cover completes the portable wardrobe closet. There are no suggestions for attaching the wire shelves with fasteners, for forming side supports for the wire shelves or for forming the six vertical poles from smaller units.

U.S. Pat. No. 5,449,076 issued on Sep. 12, 1995, to Andrew J. Van Noord describes a product facing device consisting of wire shelf racks having a spring loaded element for urging packaged goods such as videotapes towards the front of a shelf. The rear of a shelf has two parallel horizontal wire bars welded to two end convoluted wire bars for attachment to a conventional supporting device not shown. The inclined side bars and multiple movable spacer bars support another horizontal front bar with a vertical panel and a J-shaped bar grid which is further supported by two horizontal bottom bars. There are no suggestions for attachment of a rack to a modular support frame.

U.S. Pat. No. 5,072,839 issued on Dec. 17, 1991, to A. Jeanne Arnone describes a display stand assembly consisting of a channel steel or plastic frame which can stand on a floor or be mounted on a wall. A plurality of vertical flat rear posts have two columns of chair-shaped apertures facing each other in an alternate manner for hanging of removable inclined wire shelves or projecting rods. There is no suggestion for modifying the frame or the posts to be sectional for assembly.

U.S. Pat. No. 4,416,380 issued on Nov. 22, 1983, to Paul Flum describes a product merchandising rack consisting of a stacked rectangular box frame in which each open interlocking box section supports an inclined wire basket with 3 to 4 guide channels having parallel wire tracks covered with plastic sheaths or a plastic sheet of removable tracks. There is no suggestion for hanging the rack from a wall or fastening to a wall.

U.S. Pat. No. 5,477,970 issued on Dec. 26, 1995, to James Watt et al. describes an adjustable produce display rack consisting of two pivoting wire racks which have an inclined front section with horizontal bars. The upper rack can be extended telescopically upward and locked in place by a pivotal hinge structure. The rack is housed within a conforming inclined plane structure with a front rail. There is no suggestion for forming a modular structure.

U.S. Pat. No. 5,503,279 issued on Apr. 2, 1996, to Richard W. Wentworth describes a height and angle-adjustable display rack for use in a display wall case with the wire elements made from epoxy-coated metal. The three basic parts are (1) an expandable tilt top and (2) an expandable base frame which are held together by (3) a U-shaped tilt bar. The base frame has a pair of hooks in front and in the rear which lock into the display wall case (not shown). This display rack bears little structural resemblance to the present invention.

U.S. Des. Pat. No. 259,315 issued on May 26, 1981, to Allan L. Ford et al. describes a multi-unit belt display fixture consisting of two posts supported by two joined square floor bases and two horizontal plates on top. Each post supports a triangular shaped rack with extended hooks for hanging belts. It is unclear whether any parts can be disassembled readily, and this display rack bears little structural significance relative to the present invention.

U.S. Pat. No. 5,240,124 issued on Aug. 31, 1993, to Gene Buday describes a rectangular storage cart on wheels which support vertically inclined storage racks filled with slidable containers of baked goods or dough. The wire racks have three chutes with a front stop guide wire and a wire rib member which stops the containers from having their lids knocked off or cocking the packages forward. The cart is not adapted to be readily assembled or disassembled as in the present invention for positioning in various locations.

German Patent No. 411,278 issued on Nov. 15, 1966, to Adolf Spinner describes a display stand having a top cover, a solid back panel and two rear apertured posts with cross-braces for supporting horizontal or inclined shelves with wire baskets or solid walled compartments. An apertured foot extends from each post to support the stand as well as the bottom shelf. It is clear from the drawings that the posts are not segmented and the shelves are not attached as in the present invention.

None of the above inventions and patents, taken either singularly or in combination, is seen to describe the instant invention as claimed. Thus a display equipment solving the aforementioned problems is desired.

SUMMARY OF THE INVENTION

The present invention provides a display equipment system for use in stores for displaying merchandise such as non-perishable foods on standing or hanging racks with lightweight open wire containers angled downward for greater display and accessibility. The racks can be assembled from interfitting parts and disassembled readily for placement in different areas of the store at different heights such as on the floor, on a counter or hanging from other containers, ledges or walls for display of the goods. The number of wire containers or baskets on each rack can be varied in height as well as in length. Specially structured fasteners for joining the frame and holding the baskets to the frame are shown.

Accordingly, it is a principal object of the invention to provide a display equipment system for foodstuffs prefabricated for installation in various regions of a store, gasoline service station or the like.

It is another object of the invention to provide a display equipment system which can be fabricated for installation on counters, on floors, and hung from ledges, walls or other furniture.

It is a further object of the invention to provide a display equipment system with a minimum of different parts which fit together to fabricate a display rack of different configurations for use in different locations.

Still another object of the invention is to provide a display equipment system with specially adapted fasteners for fabricating a display structure, holding the baskets to the frame and hanging from or against a wall.

It is an object of the invention to provide improved elements and arrangements thereof in display equipment for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention provides an economical display equipment system which can be fabricated from parts for use in various regions of a store as free-standing or hanging to display merchandise.

Figure 1:
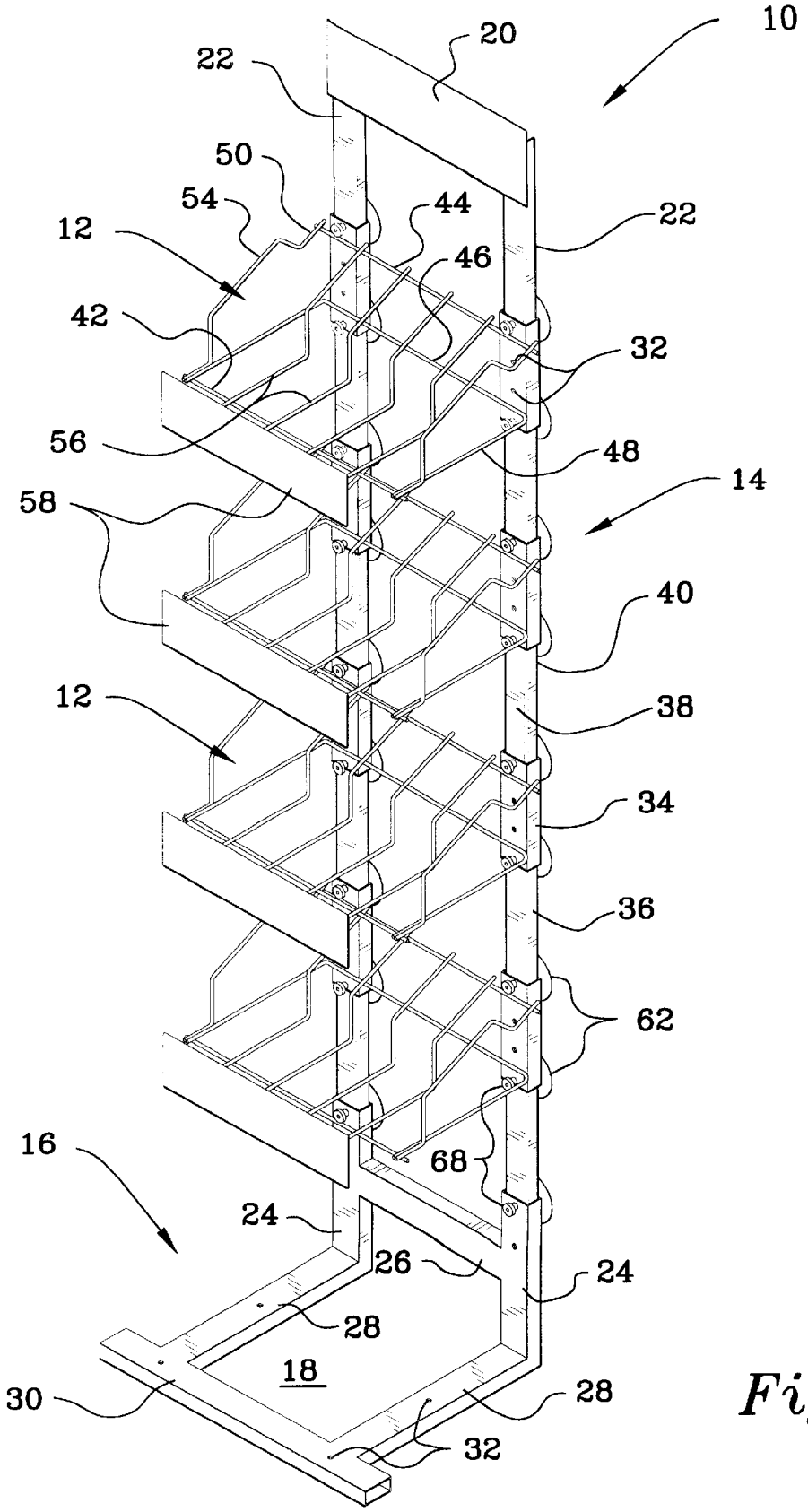
FIG. 1 is a perspective view of a first embodiment of a self-standing display rack according to the present invention.
Figure 2:
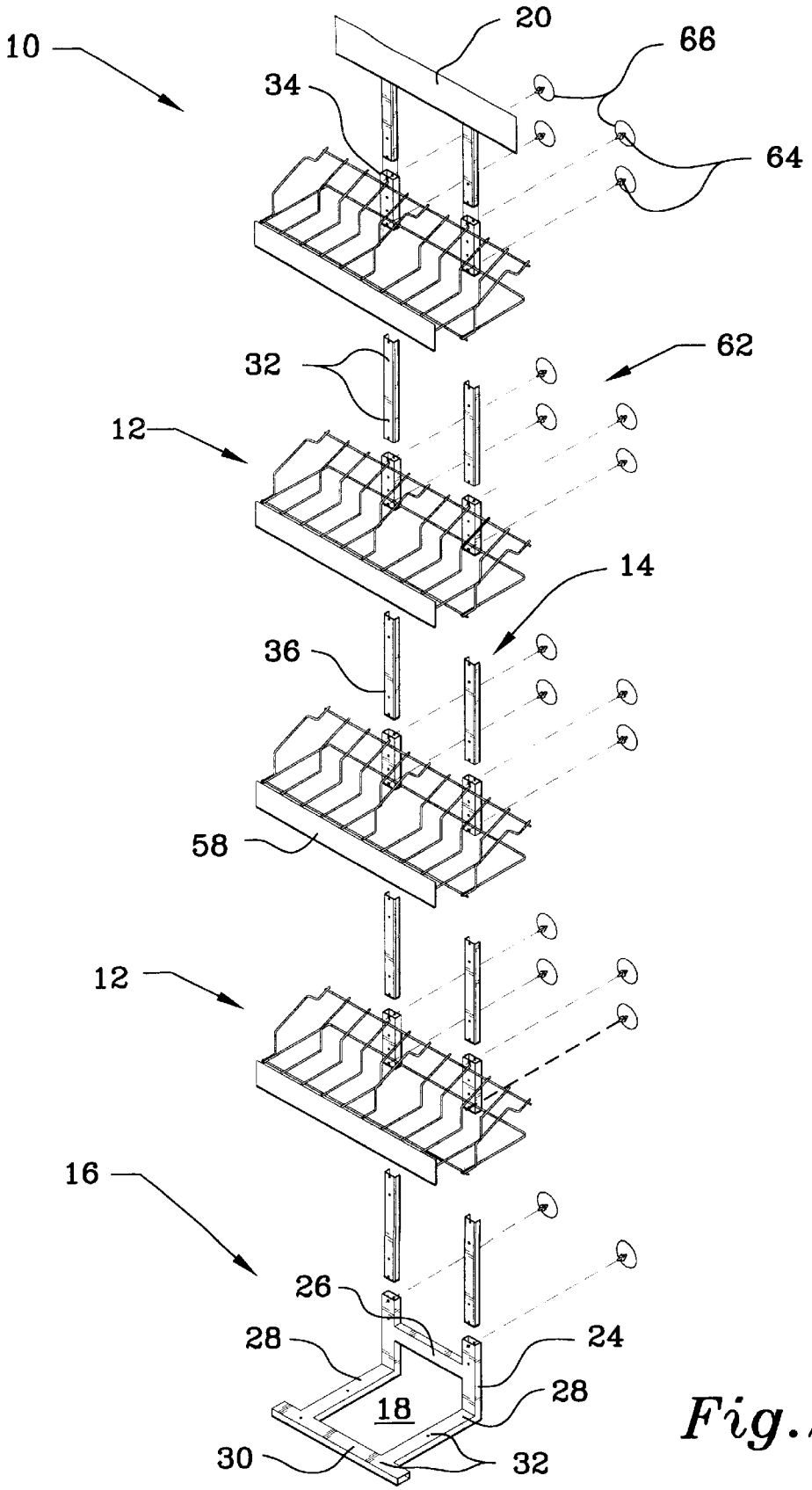
FIG. 2 is an exploded perspective view of the first embodiment of FIG. 1.

FIGS. 1 and 2 are drawn to a first embodiment of a free-standing display rack 10 with four wire containers or baskets 12 arranged in a vertical stack on the upright frame section 14 supported by an L-shaped stand support base element or section 16 on the floor 18. The frame section 14 has a rectangular plate or brace element 20 fastened on top. The plate 20 serves a dual function of supporting the two vertical posts 22 which are hollow and rectangular in cross-section and enabling the posting of any indicia advertising the merchandise exhibited. The posts 22 are supported on the bottom by a hollow integrated stand section 16 which has a right angle bend of upright elements 24 connected by an upper crossbar 26 and the foot elements 28 connected by another lower or terminal crossbar 30 which extends beyond the ends of the foot elements 28. Apertures 32 are present in the foot elements 28 and the lower crossbar 30 for optional fastening of the rack 10 to the floor 18.

The pair of hollow posts 22 are fabricated from a system of tubular frame segments 34 and extension segments 36. Each frame segment 34 has four apertures 32 aligned along its length through a front wall 38 and a rear wall 40 shown in FIG. 6. Each extension segment 36 has only two apertures 32 on each wall 38, 40 (FIG. 1).

Figure 3:
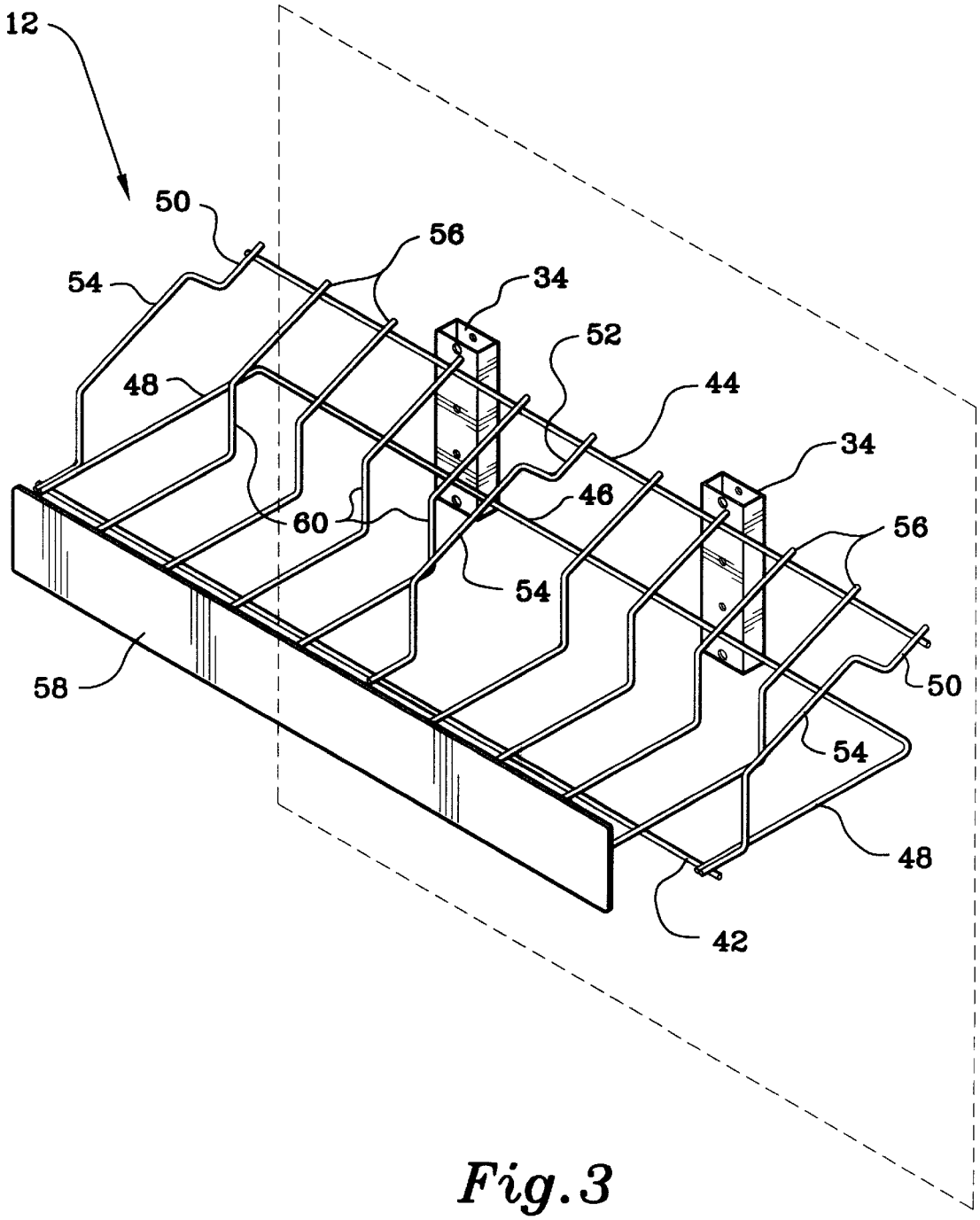
FIG. 3 is an enlarged and exploded perspective view of one merchandise basket separated from its stand segment of the first embodiment of FIG. 1.
Figure 4:
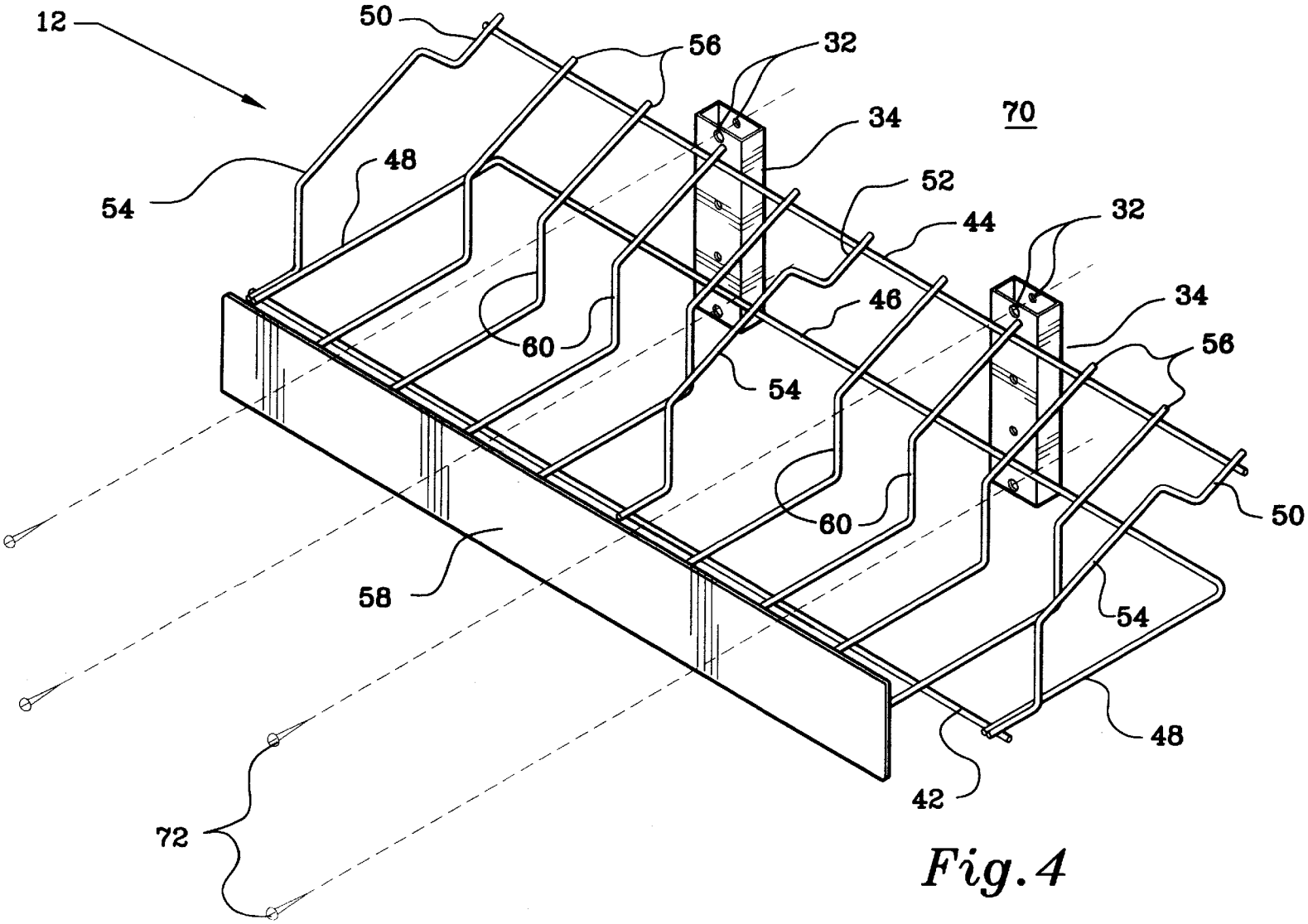
FIG. 4 is an enlarged and exploded perspective view of a second embodiment of one display segment which can be attached to a wall.

Each basket 12 is rectangular and made from metal wires or rails having specific configurations depending on its position and function. A straight front bottom wire rail 42, a straight rear upper wire rail 44, a U-shaped bottom wire rail 46 with perpendicular side rail segments 48, two side wire rails 50 with a raised mid-section 54, and at least one intermediate separating wire rail 52 with a raised mid-section 54 are joined by welding to form a basic basket frame (FIGS. 3 and 4). A plurality of parallel stepped support wires 56 are connected perpendicularly at its front ends to a midpoint of a rectangular plate 58 and its rear ends to the upper rear wire rail 44 for supporting packaged merchandise. The plate 58 serves to both hold the merchandise and to enable the addition of advertising or identifying indicia describing the products available. It should be noted that the stepped support wires 56 rest on the front bottom wire rail 42 and can be welded at the junctions to form a lightweight but durable basket 12. The packages of food or the like merchandise can now be positioned in an inclined position by the stepped support wires 56 from the step 60 to the plate 58. Different products can be placed in the basket 12 and separated by the intermediate separating rails 52. Since the baskets 12 are light in weight and durable, a plurality of baskets 12 can be assembled on the free-standing display rack 10 vertically as well as horizontally, and held in place by a pair of first fasteners 62 on top and on the bottom. It is noted that the upper fastener 62 prevents the rear upper rail 44 of a basket from moving up while the lower fastener 62 prevents the rear bottom rail 46 from dropping. A fastener 62 has a rod 64 connected to a flat circular plate or disc 66 at its rear end and an apertured button 68 at its front end. The disc 66, the rod 64 and the latching button 68 can be made entirely of metal with roughening of the rod surface and the mating internal surface of the aperture in the button for a friction fitting. Alternatively, the button 68 and the disc 66 can be made of tough but resilient plastic. The plastic disc 66 would cause less abrasion when contacting a wall.

FIG. 4 as a second embodiment illustrates the attachment of at least one basket 12 with its pair of tubular frame segments 34 attached to a wall or wall board 70 by fasteners such as screws or bolts 72 passing through the upper and lower apertures 32 and pinning down the rear upper rail 44 and the lower rear bottom rail 46.

Figure 5:
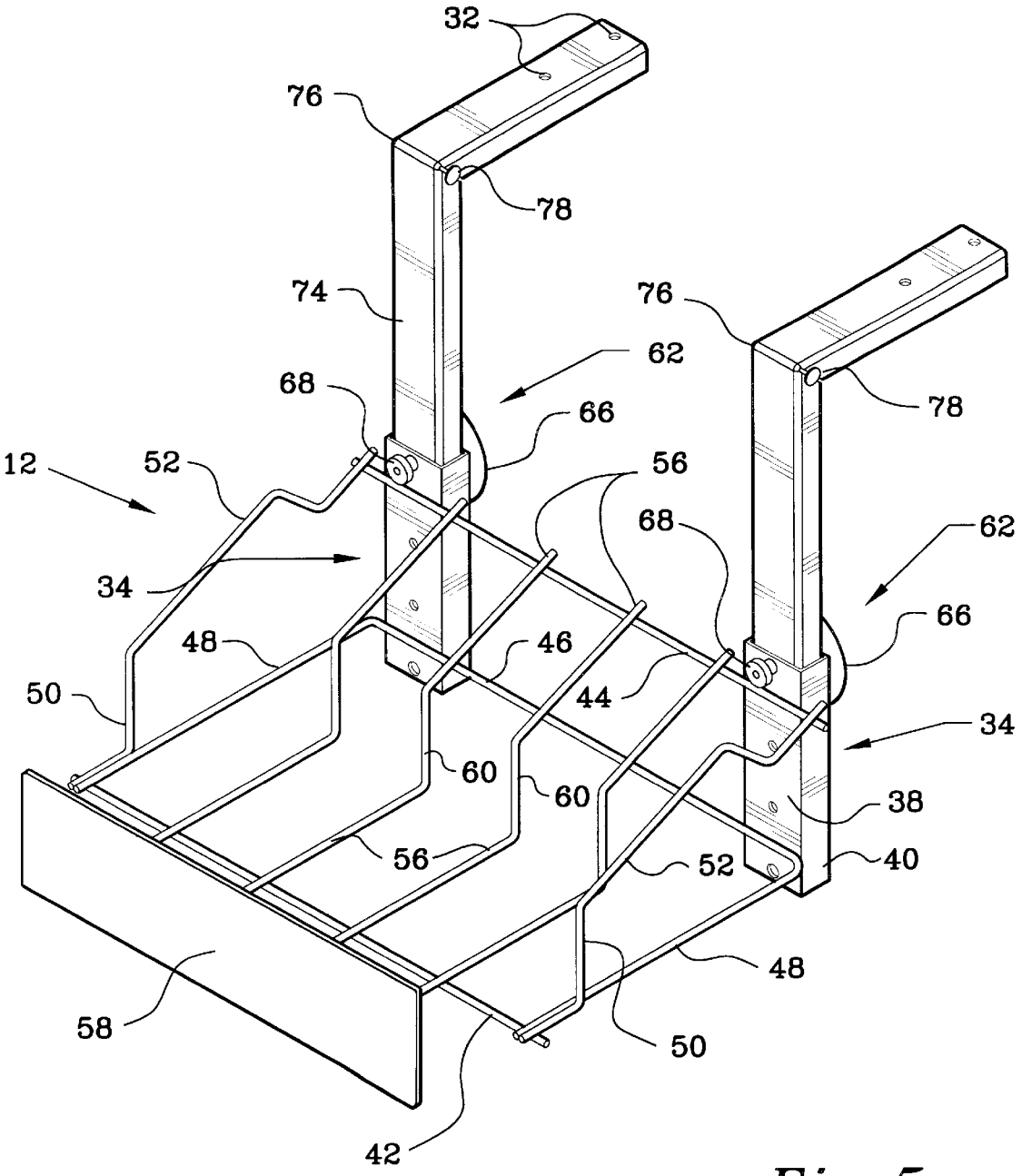
FIG. 5 is an enlarged perspective view of a third embodiment of one display segment suitable for hanging from a shelf or a furniture piece.
Figure 6:
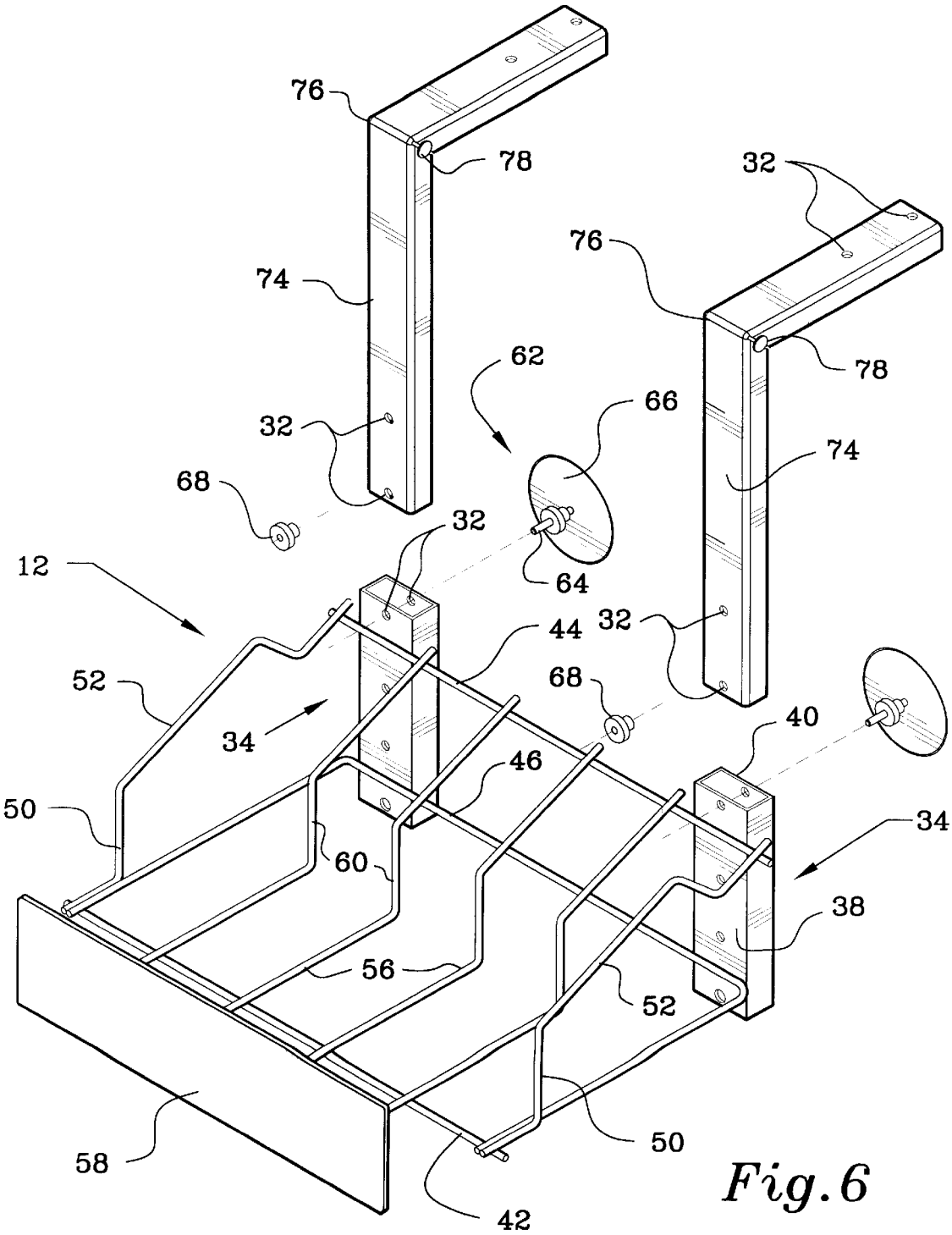
FIG. 6 is an exploded perspective view of the third embodiment of FIG. 5.

FIGS. 5 and 6 are directed to a third embodiment wherein at least one basket 12 is positioned from a ledge, shelf or furniture piece (not shown). The only modification is a pair of inverted L-shaped tubular brackets 74 for attachment to the upper ends of the vertical tubular frame segments 34 by the first post fasteners 62. If the bracket 74 is constructed of metal such as alloys of aluminum or iron, the corner 76 is fabricated by a cutout and the corner secured by a rivet 78 as shown. However, it is within the ambit of the present invention to bend the tube to form the corner and to form the bracket 74 from extruded plastic. A series of apertures 32 are provided for attachment of the bracket 74 to a wall, ledge or the like and to the uppermost tubular frame segment 34 by second fasteners 72 (FIG. 4) on top and first fasteners 62. Although only one representative basket is depicted in FIGS. 5 and 6, it is understood that a multiplicity of baskets can be hung below the shown basket and along the basket with the attendant posts 22 and brackets 74.

Figure 7:
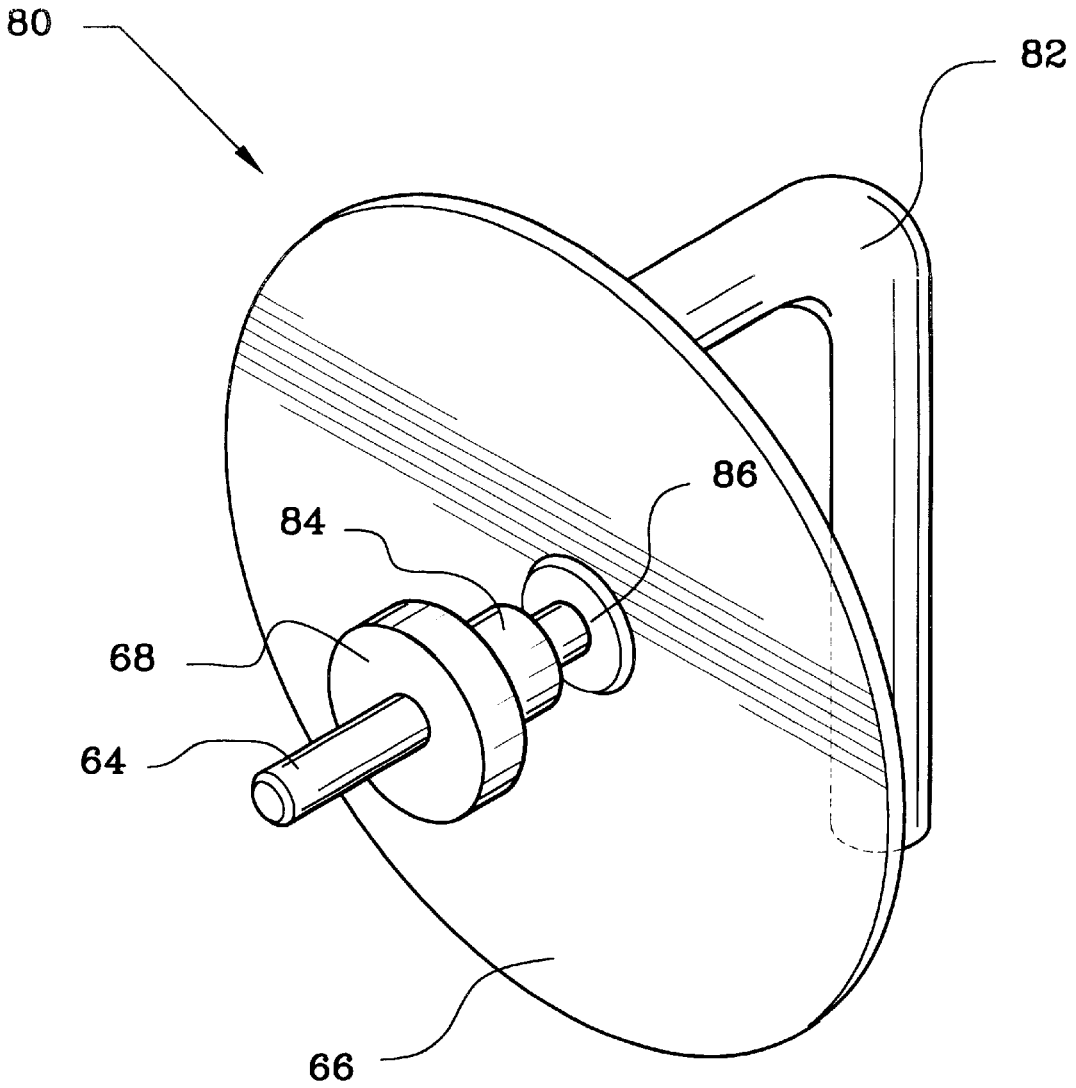
FIG. 7 is an enlarged perspective view of a fourth embodiment of a hooked fastener which can be utilized to hang a display rack from a vertical board.

Turning to FIG. 7, a fourth embodiment of a hooked fastener 80 can be utilized to hang a display rack from a vertical board. The configuration and the materials which make up the fastener 80 are as discussed for the fasteners in FIGS. 5 and 6. The hook 82 is formed with the disc 66. It is noted that the button 68 has a shoulder 84 and a similar shoulder 86 on the disc 66 to engage the apertures 32 of the upright frame section 14.

Figure 8:
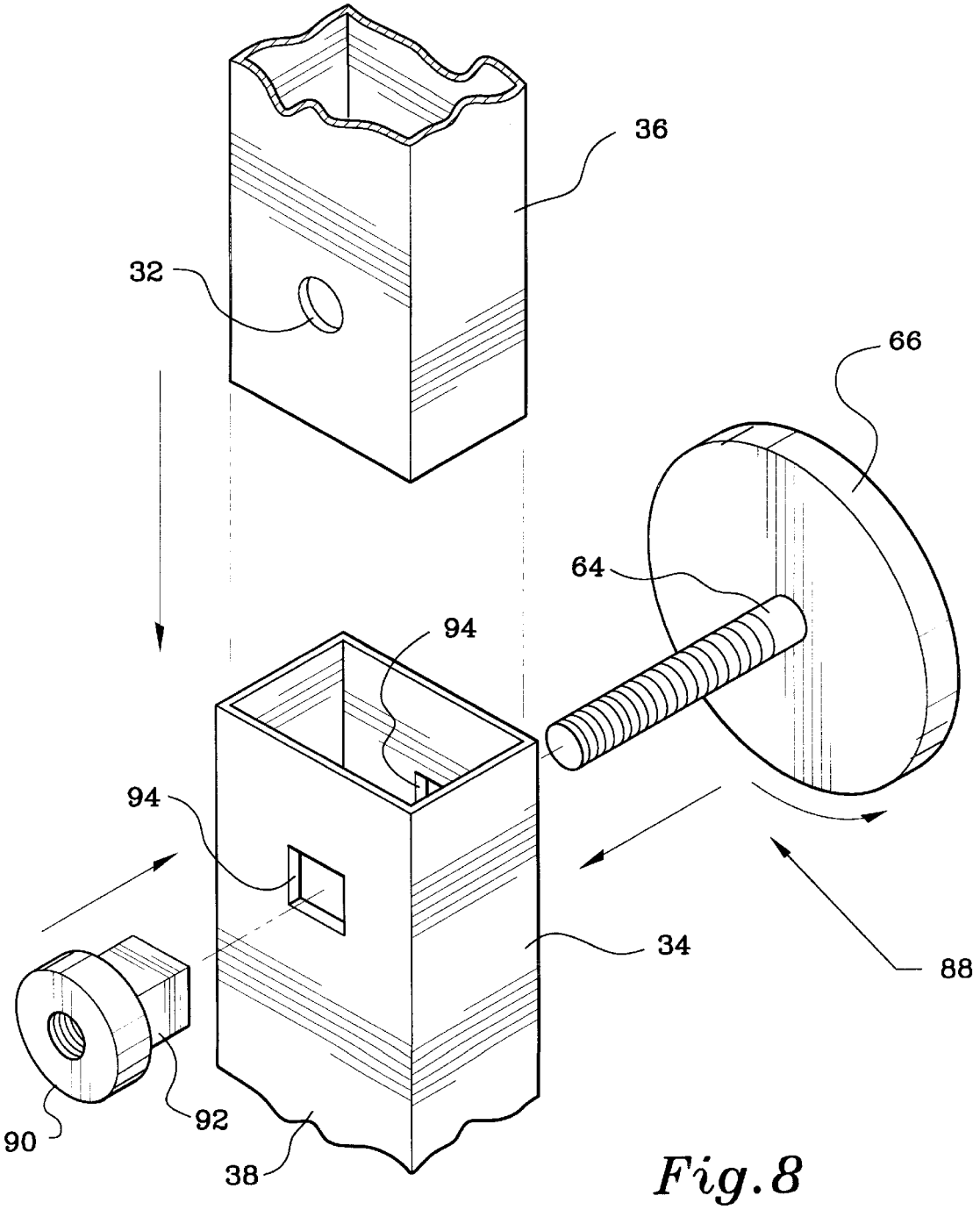
FIG. 8 is an enlarged breakaway view of a fifth embodiment of a threaded fastener and a post segment with square portions.

FIG. 8 illustrates a preferred fifth embodiment of a threaded fastener 88 with a button 90 having a locking square configured portion or shoulder 92 which interlocks with the front square hole 94 in the tubular frame segment 34. The disc 66 now has a threaded rod 64 which mates with the internal threading of the button 90. The threaded rod 64 has a predetermined length which should not protrude excessively from the button 90 when the fastener 88 is secured. The shoulder 92 only penetrates the thickness of the front wall 38 of the frame segment 34 for securing the button 90 with respect to the frame segment. However, the tubular extension segment 36 retains the apertures 32. This embodiment is believed to implement a more secure attachment fastener.

It is to be understood that the present invention is not limited to the embodiments described above, but encompasses any and all embodiments within the scope of the following claims.

I claim:

1. A display equipment system for exhibiting merchandise comprising:

a rectangular wire basket having:

a straight front bottom wire rail;

a straight rear upper wire rail including a straight rear wire rail segment;

a bottom wire rail having two straight side rail segments perpendicular to said straight rear wire rail segment, wherein said rear upper wire rail is connected at its ends to said front bottom wire rail at its ends to form a rectangular support frame with front corners;

two side wire rails with raised mid-sections with their front portions connected at the front corners of the rectangular support frame and their rear portions connected to the straight upper rear wire so as to incline the two side wire rails;

at least one intermediate separating wire rail with a raised mid-section connected perpendicularly at its ends to each of said front bottom and upper rear wire rails;

a flat rectangular plate; and a plurality of parallel stepped support wires connected perpendicularly at their front ends to said rectangular plate and their rear ends to the upper rear wire rail for supporting merchandise;

whereby merchandise can be separately displayed for impulse purchasing.

2. The display equipment according to claim 1, the straight upper rear wire rail being further supported by at least a pair of vertical tubular frame segments.

3. The display equipment according to claim 2, the straight upper rear wire rail being supported by at least the pair of vertical tubular frame segments by first fasteners configured as rods with flat circular plates in the rear ends and passing through the frame segments for holding the straight upper rear wire with apertured buttons against the vertical frame segments.

4. The display equipment according to claim 3, the first fasteners and apertures in each vertical tubular frame segment for securing each wire basket being configured with a square portion.

5. The display equipment according to claim 3, at least a pair of elongated tubular extension segments being connected to at least a pair of the vertical tubular frame segments to extend the height of the display equipment.

6. The display equipment according to claim 5, including a stand support base element made up of L-shaped tubular frame leg segments with an upper tubular cross-bar and a terminal tubular cross-bar extending beyond the lower leg segments for attachment to a floor.

7. The display equipment according to claim 6, including a plurality of wire baskets being supported by a plurality of pairs of vertical tubular frame segments connected by a plurality of pairs of elongated tubular extension segments.

8. The display equipment according to claim 5, including a rectangular top brace element being connected to a front surface of at least the pair of vertical tubular frame elements for structural support and for adornment with attractive indicia.

9. The display equipment according to claim 8, including a plurality of wire baskets being supported by a plurality of pairs of vertical tubular frame segments connected by a plurality of pairs of elongated tubular extension segments.

10. The display equipment according to claim 2, including a pair of inverted L-shaped tubular support brackets for attachment to an upper end of the pair of vertical tubular frame segments supporting at least one basket for hanging the display equipment from a ledge.

11. The display equipment according to claim 2, the vertical tubular frame segments having a rectangular cross-section.

12. A display equipment system for exhibiting merchandise in compartmentalized baskets comprising:

a plurality of rectangular wire baskets having compartments inclined from the front portion to the rear portion for displaying merchandise separated according to brand and size; and at least two vertical tubular and segmented frame posts comprising frame segments alternating with extension segments being connected by first fasteners which fasten the frame and extension segments together and hasten the plurality of rectangular wire baskets to each frame segment.

13. The display equipment system according to claim 12, including second fasteners for attaching the display equipment system to a wall by passing through apertures in said at least two vertical tubular and segmented frame posts.

14. The display equipment system according to claim 12, including a stand support base element made up of L-shaped tubular frame leg segments with an upper tubular cross-bar and a terminal tubular cross-bar extending beyond the lower leg segments for attachment to a floor.

15. The display equipment according to claim 12, including a rectangular top brace element being connected to a front surface of at least the pair of vertical tubular frame elements for structural support and for adornment with attractive indicia.

16. The display equipment according to claim 12, including a pair of inverted L-shaped tubular support brackets for attachment to an upper end of the pair of vertical tubular frame segments supporting said plurality of baskets for hanging the display equipment from a ledge.

17. The display equipment according to claim 12, the vertical tubular frame segments having a rectangular cross-section.

18. The display equipment according to claim 12, the plurality of baskets being supported by at least the pair of vertical tubular frame segments by first fasteners configured as rods with flat circular plates in the rear ends and passing through the frame segments for holding the plurality of baskets with apertured buttons against the vertical frame segments.

19. A fastener for display equipment posts having square holes for securing wire baskets comprising:

a rod having a front threaded end and a rear end;

a flat circular plate attached to the rear end of the rod; and an apertured and threaded circular button with a square portion threadably attachable to the front end of the rod; whereby the fastener passing through square holed posts of the display equipment for securing the wire baskets.

20. The fastener according to claim 19, including a hook portion extending from the rear surface of the flat circular plate for hanging the display equipment from a vertical wall portion.

* * * * *